US007415912B2

(12) United States Patent
Tyler

(10) Patent No.: US 7,415,912 B2
(45) Date of Patent: Aug. 26, 2008

(54) LOCKING CLAMP DEVICE

(75) Inventor: Terence P. Tyler, Strong, ME (US)

(73) Assignee: Maine Land Research & Development, Inc., Skowhegan, ME (US)

( * ) Notice: Subject to any disclaimer, the term of this patent is extended or adjusted under 35 U.S.C. 154(b) by 0 days.

(21) Appl. No.: 11/284,952

(22) Filed: Nov. 22, 2005

(65) Prior Publication Data

US 2007/0051213 A1 Mar. 8, 2007

Related U.S. Application Data

(60) Provisional application No. 60/714,030, filed on Sep. 2, 2005.

(51) Int. Cl.

| | |
|---|---|
| ***B25B 7/12*** | (2006.01) |
| ***B25B 7/02*** | (2006.01) |
| *B25B 5/02* | (2006.01) |
| *B25B 5/12* | (2006.01) |

(52) U.S. Cl. ..... 81/367; 81/423

(58) Field of Classification Search ..... 81/177.2, 81/180.1, 186, 367, 418, 421, 422, 423, 426; 269/6

See application file for complete search history.

(56) References Cited

U.S. PATENT DOCUMENTS

| | | | | | |
|---|---|---|---|---|---|
| 753,456 | A | * | 3/1904 | Weidinger | 7/133 |
| 3,446,102 | A | * | 5/1969 | Hallmark | 81/369 |
| 3,496,808 | A | * | 2/1970 | Schmidt | 81/370 |
| 3,779,108 | A | | 12/1973 | Reiter | |
| 4,133,519 | A | | 1/1979 | Shin et al. | |
| 4,344,215 | A | * | 8/1982 | Dearman | 29/281.5 |
| 4,378,937 | A | * | 4/1983 | Dearman | 269/6 |
| 4,729,281 | A | * | 3/1988 | Holloway, Jr. | 81/177.2 |
| 4,834,352 | A | * | 5/1989 | Thornton | 269/6 |
| 4,896,661 | A | | 1/1990 | Bogert et al. | |
| 4,974,478 | A | * | 12/1990 | Wolff | 81/456 |
| 5,050,466 | A | * | 9/1991 | Cameron | 81/419 |
| 5,154,104 | A | * | 10/1992 | O | 81/177.2 |
| 5,499,800 | A | * | 3/1996 | Albin | 269/6 |
| 5,791,210 | A | | 8/1998 | Wolff et al. | |
| 5,884,540 | A | * | 3/1999 | Mo | 81/423 |
| 5,992,273 | A | | 11/1999 | Galea | |
| 6,029,964 | A | * | 2/2000 | Bohl | 269/6 |
| 6,134,993 | A | | 10/2000 | Tally | |
| 6,199,458 | B1 | | 3/2001 | Wrigley et al. | |
| 6,290,219 | B1 | | 9/2001 | Barbosa | |
| 6,308,597 | B1 | | 10/2001 | Stahle | |
| 6,389,936 | B1 | | 5/2002 | Domenge | |
| 6,401,578 | B1 | | 6/2002 | Domenge | |
| 6,408,724 | B1 | | 6/2002 | Whiteford | |
| 6,601,479 | B1 | | 8/2003 | Kramer | |
| 6,698,314 | B1 | * | 3/2004 | Nichols | 81/58 |
| 6,708,966 | B1 | | 3/2004 | Troudt | |

(Continued)

*Primary Examiner*—David B Thomas
(74) *Attorney, Agent, or Firm*—Anthony D. Pellegrini, Esq.

(57) ABSTRACT

An improved locking clamp device having independently extendable jaws and interchangeable quick release clamping members, said clamping members configured in unlimited variations of shape, texture, and hardness and optionally being moveable relative to the jaws of the device. The improvements allow increased flexibility of the device over traditionally configured locking clamps with regard to use of the device with difficult work pieces and environments. The interchangeable clamping members allow a single device to be used for multiple applications, thereby making the invention a low cost and convenient alternative to multiple special purpose tools, as well as permitting quick and inexpensive replacement of wear elements.

34 Claims, 12 Drawing Sheets

U.S. PATENT DOCUMENTS 6,748,830 B1 6/2004 Swanstrom, Jr.
6,761,094 B2 * 7/2004 Tobako ..... 81/177.2
6,860,179 B2 3/2005 Hopper et al.
7,104,166 B1 * 9/2006 Wong ..... 81/423
7,204,175 B2 * 4/2007 Hsieh ..... 81/177.2
2002/0157507 A1 10/2002 Chou
2003/0015072 A1 1/2003 Chou

* cited by examiner

LOCKING CLAMP DEVICE

CROSS REFERENCE TO RELATED APPLICATION

This application claims priority to a provisional application, U.S. Ser. No. 60/714,030, filed Sep. 2, 2005, entitled Locking Clamp Device, by Tyler, Terence P., which is hereby incorporated by reference.

BACKGROUND OF THE INVENTION

1. Technical Field

The invention relates generally to the field of hand tools. More specifically, the invention is directed to an improved locking clamp device suitable for use with difficult work pieces and environments.

2. Description of Prior Art

Locking clamps are well-known in the art. Vise-Grip™ brand locking pliers are an example. Such clamps include a handle mechanism, a clamping mechanism manipulated by the handle mechanism, and a locking mechanism suitable for retaining the clamping mechanism in a fixed position relative to a work piece. There many different known methods for implementing these basic structures, for which myriad patents have been issued. The great majority of these prior patents involve various improvements or modifications to the locking mechanisms. See Kramer, U.S. Pat. No. 6,601,479 (Aug. 5, 2003), SELF ADJUSTING LOCKING PLIERS, disclosing one-handed locking pliers; Wrigley, et al., U.S. Pat. No. 6,199,458 (Mar. 13, 2001), LOCKING PLIERS, disclosing locking pliers with internal springs to provide tension and a thumb catch for locking/unlocking the tool. Other patents disclose mechanisms for adjusting the angle of the jaws of the clamping mechanisms to accommodate different sizes of work pieces to be gripped. See Whiteford, U.S. Pat. No. 6,408,724 (Jun. 25, 2002), SELF ADJUSTING PLIER-LIKE LOCKING TOOL, disclosing locking tool adjustable to different sized work pieces. Other patents involve tools having jaws which move in relation to the handle mechanisms. See Troudt, U.S. Pat. No. 6,708,966 (Mar. 23, 2004), ADJUSTABLE C-CLAMP, disclosing clamping mechanism with telescoping functionality to widen the distance between the jaws; Chou, U.S. Patent Application No. 2003/0015072 (Jan. 23, 2003), VARIABLE PIVOT LOCKING PLIERS, disclosing locking pliers having parallel jaws; Chou, U.S. Patent Application No. 2002/0157507 (Oct. 31, 2002), AUTOMATIC AND VARIABLE GRIP LOCKING PLIERS, disclosing locking pliers that will automatically reset the jaws to accommodate different sized work pieces; Galea, U.S. Pat. No. 5,992,273 (Nov. 30, 1999), ADJUSTABLE LOCKING PLIERS, disclosing a tool with pivotally mounted jaws which move relative to the handle.

Other patents are closer in concept to the present invention, though remain distinguishable. Stahle, U.S. Pat. No. 6,308,597 (Oct. 30, 2001), for LOCKING DEVICE FOR A HAND TOOL, discloses a locking clamp having interchangeable clamping surfaces in the form of collet jaws. These are described as having a rib which fits into a channel formed into the end of the jaw of the clamp; the various collet jaws may be slid into and out of the channel to quickly change the function of the clamp. The collect jaws may also pivot. This differs from the present invention in that the collet jaws are not variously shaped or contoured to accommodate different work piece surfaces, they cannot be rotated relative to the jaws, and they cannot be used to simulate spot welding marks. Moreover, Stahle does not disclose extendable jaws. Bogert, et al., U.S. Pat. No. 4,896,661 (Jan. 30, 1990), for MULTI PURPOSE ORTHOPEDIC RATCHETING FORCEPS, discloses locking surgical forceps having readily interchangeable tips, said tips able to be rotated along the axis of the arm. However, the clamping tips cannot pivot and are not resilient or contoured, and the jaws are not extendable. Hopper, et al., U.S. Pat. No. 6,860,179 (Mar. 1, 2005), for CLAMP DEVICE, discloses clamping surfaces which may be removed from the jaws. These removable clamping surfaces are designed as wear items and are not intended to be interchanged with different clamping surfaces during use to accommodate different work pieces. Hopper, et al., does not teach the use of differently shaped clamping surfaces, variable materials for clamping surfaces, or the concept of positional clamping surfaces. Reiter, U.S. Pat. No. 3,779,108 (Dec. 18, 1973), for CLAMP, discloses a variation of a spring clamp, with gripping surfaces pivoting in one dimension and with the arms of the jaws themselves rotating. The Reiter clamp also discloses resilient pads covering the clamping surfaces. These are not interchangeable, however, nor are the clamping surfaces of diverse shapes. Finally, the Reiter clamp discloses extendable arms, but the extension is lateral, perpendicular to the handles, thereby only providing for a wider grip, and not for extending axially from the handles. Barbosa, U.S. Pat. No. 6,290,219 (Sep. 18, 2001), C-CLAMP PLIER WITH SUPPORT EXTENSION ARM, discloses an extendable arm attachment to be used in combination with a clamp. It is distinct from the telescoping extendable jaws concept of the present invention in that it has an independent extension arm to be placed on an existing jaw of the clamp, plus a counter-pressure point below the jaw.

Other patents disclose individual concepts similar to the present invention, but represent inferior solutions. Swanstrom, Jr., U.S. Pat. No. 6,748,830 (Jun. 15, 2004), for THREADED GRIPPING BAR PLIERS INSERT, discloses replaceable clamping surfaces. However, these clamping surfaces are replaced only as wear items, are fixed when in use, and are not intended for quick release or interchangeability during use. Domenge, U.S. Pat. No. 6,401,578 (Jun. 11, 2002) and U.S. Pat. No. 6,389,936 (May 21, 2002), for HAND TOOL HAVING PIVOTING HANDLES, disclose pliers with pivoting contact elements on the jaws. These are fixed onto the jaws, and designed to grip only six-sided fasteners. Tally, U.S. Pat. No. 6,134,993 (Oct. 24, 2000), for PLIERS WITH ADJUSTABLE JAWS, discloses pliers with jaws that may be oriented in various positions relative to the handles. This patent discloses soft clamping surfaces, though these are in fact simply vinyl jaw covers placed over the gripping surfaces to protect the work piece. They are not designed to be readily interchanged for use with different types of work pieces. Wolff, et al., U.S. Pat. No. 5,791,210 (Aug. 11, 1998), for SPRING-TENSIONING PLIERS, discloses pivoting clamping surfaces, similar to the pivoting clamping surfaces disclosed in Reiter. However, the clamping surfaces are not interchangeable and pivot in one dimension only. Shin, et al., U.S. Pat. No. 4,133,519 (Jan. 9, 1979), for VISE WITH SELECTABLE JAW FACES, discloses the use of interchangeable clamping surfaces to be used with different types of work pieces. However, the mechanism for changing the clamping surfaces is a disk which is rotated to position the desired clamping surface for use. This is limited to just a few different clamping surfaces. Moreover, the mechanism is not suitable for use in a hand tool.

None of the disclosed prior art offers all of the functionality disclosed in the present invention. Moreover, the implementation of similar individual concepts in earlier patents differs significantly with the implementation of the present invention. Thus none of the disclosed prior art anticipates the present invention.

It is an objective of the present invention to provide a useful, improved locking clamp device with independently extendable jaws to provide for improved access to difficultly situated work pieces and for offset clamping.

It is a further objective of the present invention to provide a useful, improved locking clamp device with quick release interchangeable clamping members.

It is a further objective of the present invention to provide a useful, improved locking clamp device with clamping members moveable relative to the jaws to better accommodate work pieces.

It is a further objective of the present invention to provide a useful, improved locking clamp device with variously shaped clamping members suitable for use with difficultly situated work pieces.

It is a further objective of the present invention to provide a useful, improved locking clamp device suitable for creating simulated spot welds in metal work pieces.

Other objectives of the present invention will be readily apparent from the descriptions that follows.

SUMMARY OF THE INVENTION

The preferred embodiment of the present invention is an improved locking clamp device having a handle assembly, suitably adapted to be held and manipulated by a human hand; a clamping assembly having a first jaw portion and a second jaw portion, with the jaw portions comprised of two or more arms slidably moveable along each other's respective longitudinal axes such that the jaw portions may be lengthened or shortened as needed; a first clamping member removably attached to the first jaw portion and a second clamping member removably attached to the second jaw portion, with the clamping members suitably adapted to engage with a work piece; and a locking means intergrated with the respective handles, adapted to hold the clamping assembly in a fixed position relative to a work piece. In this embodiment the clamping members may pivot or may rotate along an axis perpendicular to the longitudinal axis of the corresponding jaw, to provide greater flexibility in gripping difficultly shaped work pieces. The clamping members also are configurable in any number of shapes, textures, and hardnesses.

Other features and advantages of the invention are described below

DETAILED DESCRIPTION OF THE INVENTION

The present invention is directed to an improved locking clamp device 1.

Figure 1:
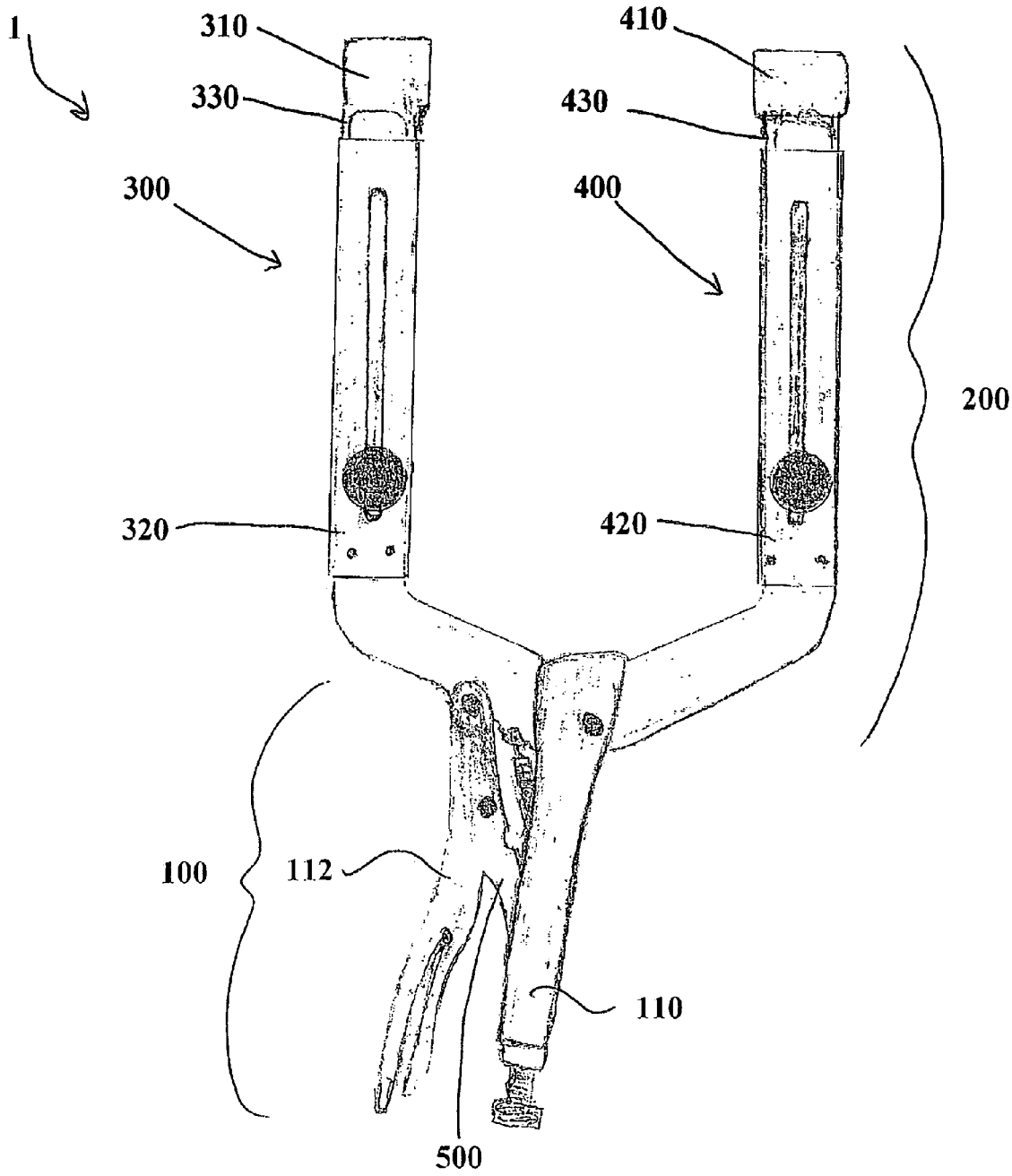
FIG. 1 is a plan view of the locking clamp device depicting the basic components of the handle assembly and the clamping assembly.

The locking clamp device 1 comprises a handle assembly 100, a clamping assembly 200, and a locking means 500. See FIG. 1. The handle assembly 100 is held by and manipulated by a human hand in order to actuate the clamping assembly 200 between an opened or a closed position, such that the clamping assembly 200 may sufficiently engage a work piece when in the closed position to hold the work piece securely within the locking clamp device 1 or to hold the locking clamp device 1 securely to the work piece, and the locking clamp device 1 may sufficiently disengage the work piece when in the opened position to permit removal of the work piece from the locking clamp device 1 or to permit removal of the locking clamp device 1 from the work piece. The locking means 500 is adapted to retain the locking clamp device 1 in the closed position. The locking means 500 may be any appropriate locking means known in the art suitable for accomplishing the stated function, for example the locking means employed by the Vise-Grip™ brand locking pliers.

The handle assembly 100 has a first handle portion 110 and a second handle portion 112, said handle portions suitably adapted to be held and manipulated by a human hand. The two handle portions are pivotally in connection with each other.

The clamping assembly 200 is attached to and integrated with the handle assembly 100. It is comprised of a first jaw portion 300 and a second jaw portion 400. See FIG. 1. Manipulation of the handle assembly 100 causes the jaw portions 300,400 of the clamping assembly 200 to move relative to each other, in that moving the first handle portion 110 towards the second handle portion 112 causes the first jaw portion 300 to move towards the second jaw portion 400, and moving the first handle portion 110 away from the second handle portion 112 causes the first jaw portion 300 to move away from the second jaw portion 400. The locking means 500 allows the first jaw portion 300 to be retained in a fixed position relative to the second jaw portion 400. There are many different configurations for such a handle assembly/clamping assembly/locking means combination which embody the above-described characteristics, all well known in the art, and all applicable to the present invention.

One embodiment of the present invention comprises a two-part first jaw portion 300 and a two-part second jaw portion 400. The two parts of the first jaw portion 300 are designated the proximate arm 320 and the distal arm 330, with the proximate arm 320 located closer to the handle assembly 100 and the distal arm 330 located further from the handle assembly 100. See FIG. 1. The proximate arm 320 and the distal arm 330 are suitably adapted to movably engage each other along their respective longitudinal axes. As a result, the first jaw portion 300 may be lengthened or shortened depending on the positions of the proximate arm 320 and the distal arm 330 in relation to each other. The end of the distal arm 330 furthest from the proximate arm 320 is designated the clamping end 310 of the first jaw portion 300. The second jaw portion 400 is similarly configured. This configuration of the two jaw portions 300,400 of the clamping assembly 200 gives the present invention the unique ability to be manipulated according to the work to be performed, either by lengthening or shortening the reach of the two jaw portions 300,400 to the same degree to accommodate various types and sizes of work pieces or to give the user improved access to work pieces, or by lengthening or shortening the reach of the two jaw portions 300,400 to different degrees to permit offset clamping of work pieces.

Figure 2A:
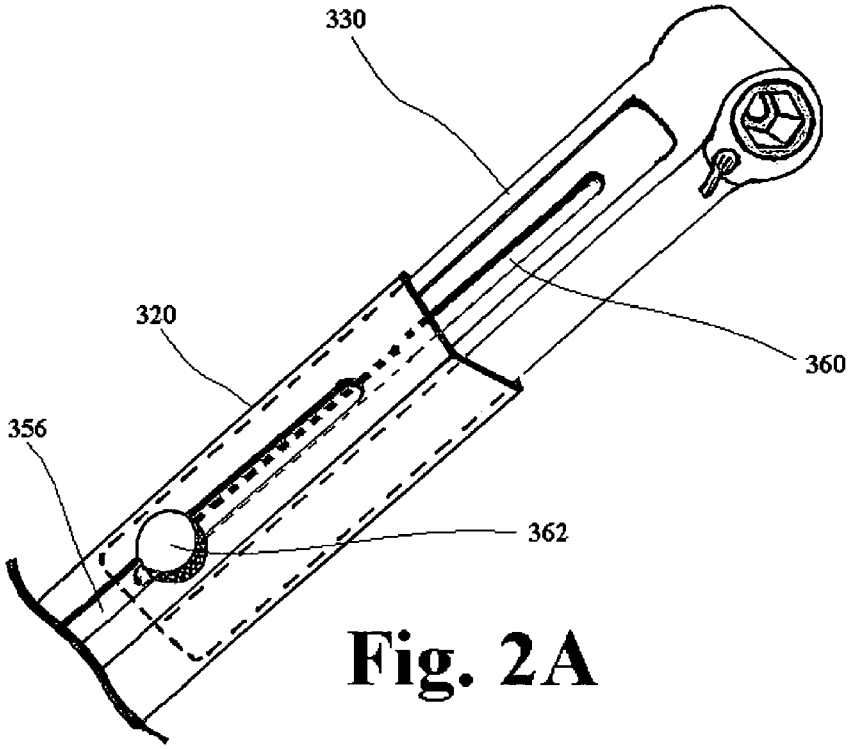
FIG. 2A is a plan view of one embodiment of the jaw assembly and first arm securing mechanism, with ghost lines depicting obscured portion of distal arm of first jaw portion.
Figure 2B:
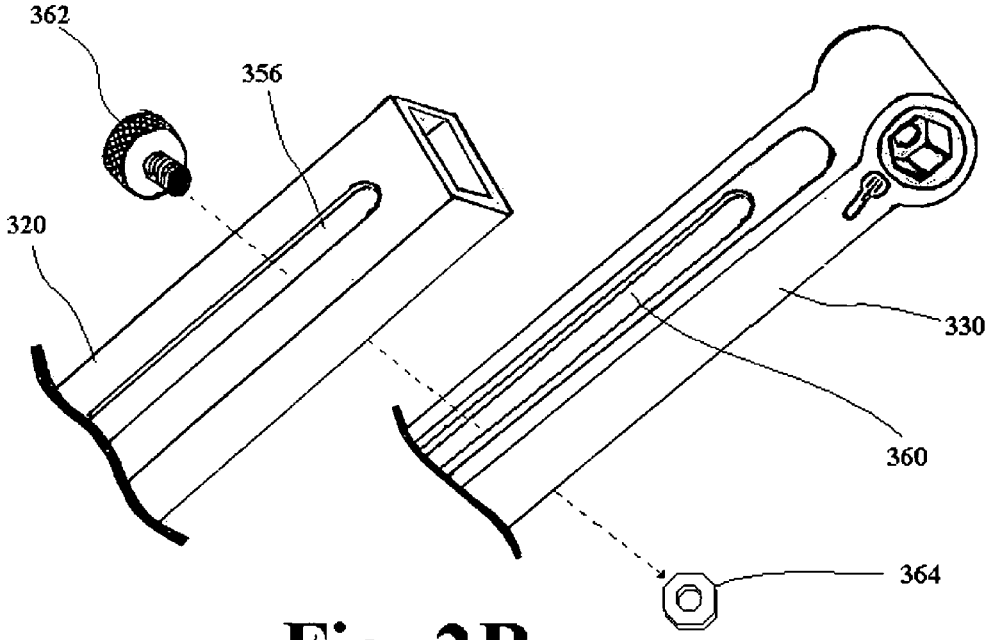
FIG. 2B is an exploded perspective view of the same embodiment of the jaw assembly and first arm securing mechanism shown in FIG. 2A.

In the first jaw portion 300 in this embodiment, the distal arm 330 may be mechanically secured in a desired position relative to the proximate arm 320 by an arm securing mechanism. In one configuration the arm securing mechanism may comprise an elongate aperture 356 in the proximate arm 320, the elongate aperture 356 passing completely through the proximate arm 320; an elongate aperture 360 in the distal arm 330, the elongate aperture 360 passing completely through the distal arm 330 and being at least partially aligned with the elongate aperture 356 of the proximate arm 320; a threaded bolt 362 that may be inserted into and through the elongate apertures 356,360 of the proximate arm 320 and the distal arm 330; and a nut 364 suitable to be secured to the threaded bolt 362. See FIGS. 2A and 2B. The threaded bolt 362 may be tightened and loosened relative to the nut 364 by being rotated by a human hand, so that when tightened the threaded bolt 362 securely secures the proximate arm 320 to the distal arm 330 in a fixed position relative to each other. The second jaw portion 400 may have a similarly configured arm securing mechanism.

Figure 3A:
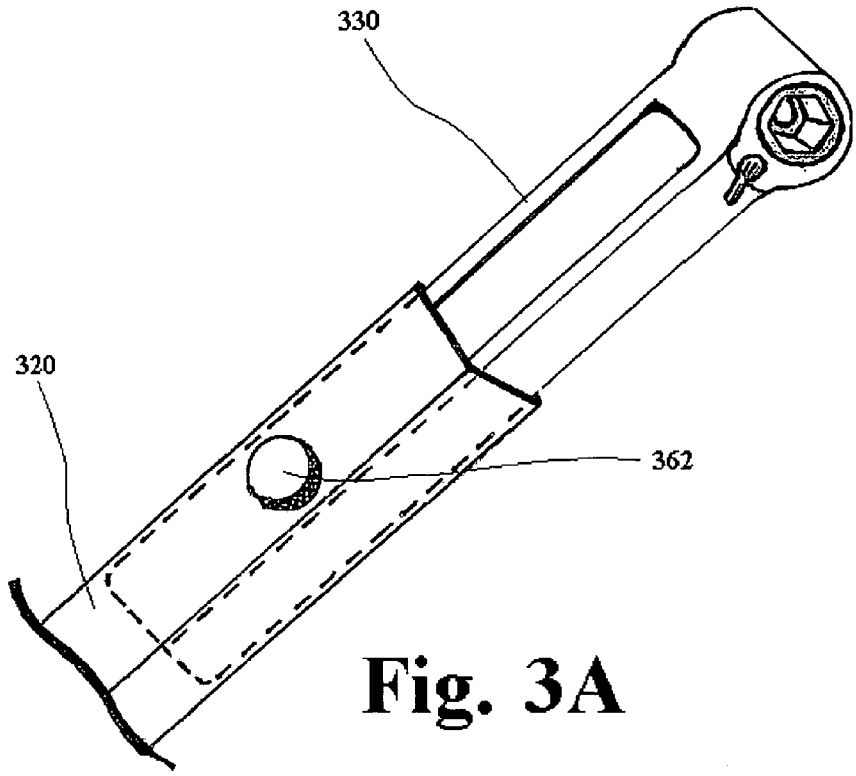
FIG. 3A is a plan view of another embodiment of the jaw assembly and first arm securing mechanism, with ghost lines depicting obscured portion of distal arm of first jaw portion.
Figure 3B:
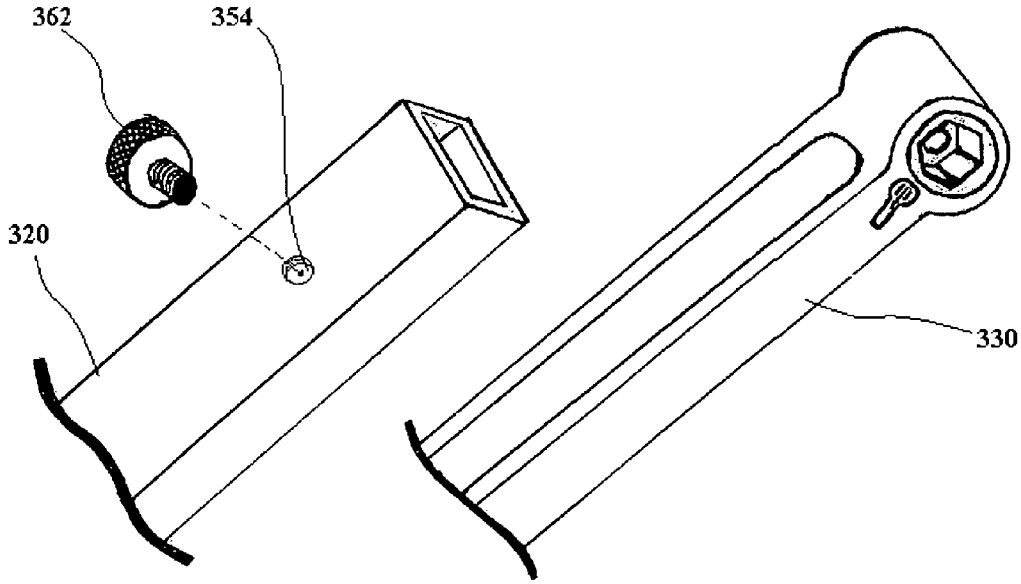
FIG. 3B is an exploded perspective view of the same embodiment of the jaw assembly and first arm securing mechanism shown in FIG. 3A.

Alternatively, the proximate arm 320 of the first jaw portion 300 may have a threaded aperture 354, with the threaded bolt 362 suitably adapted to be inserted into and through the threaded aperture 354 of the proximate arm 320 and into the distal arm 330. See FIGS. 3A and 3B. The force of the threaded bolt 362 against the surface of the distal arm 330 holds the distal arm 330 in a fixed orientation to the proximate arm 320. In such a configuration there is no need for a nut to secure the threaded bolt 362. As before, the second jaw portion 400 may have a similarly configured arm securing mechanism.

Figure 4A:
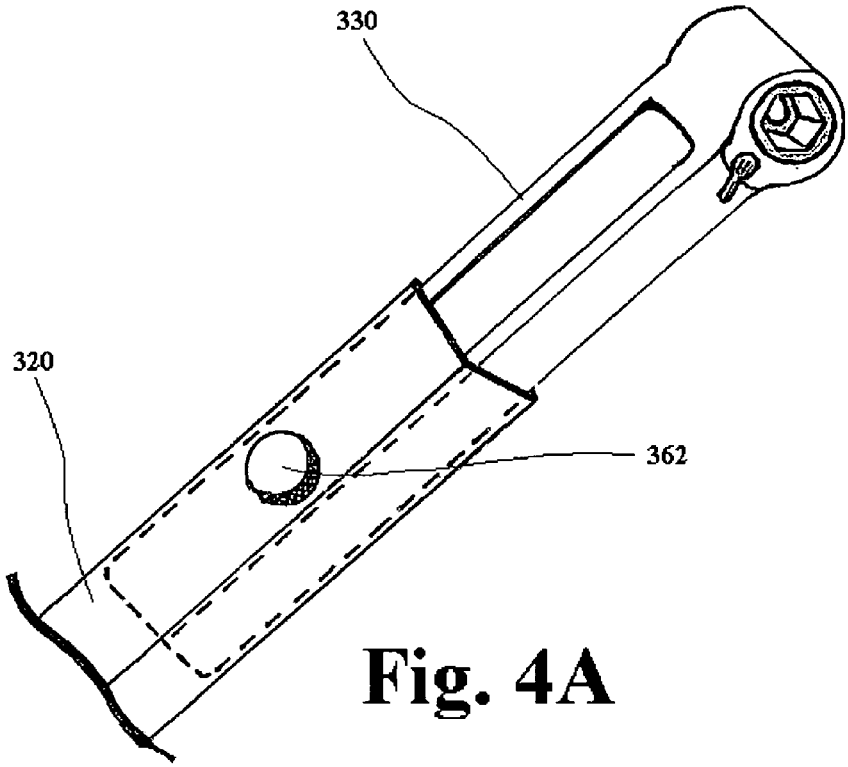
FIG. 4A is a plan view of yet another embodiment of the jaw assembly and first arm securing mechanism, with ghost lines depicting obscured portion of distal arm of first jaw portion.
Figure 4B:
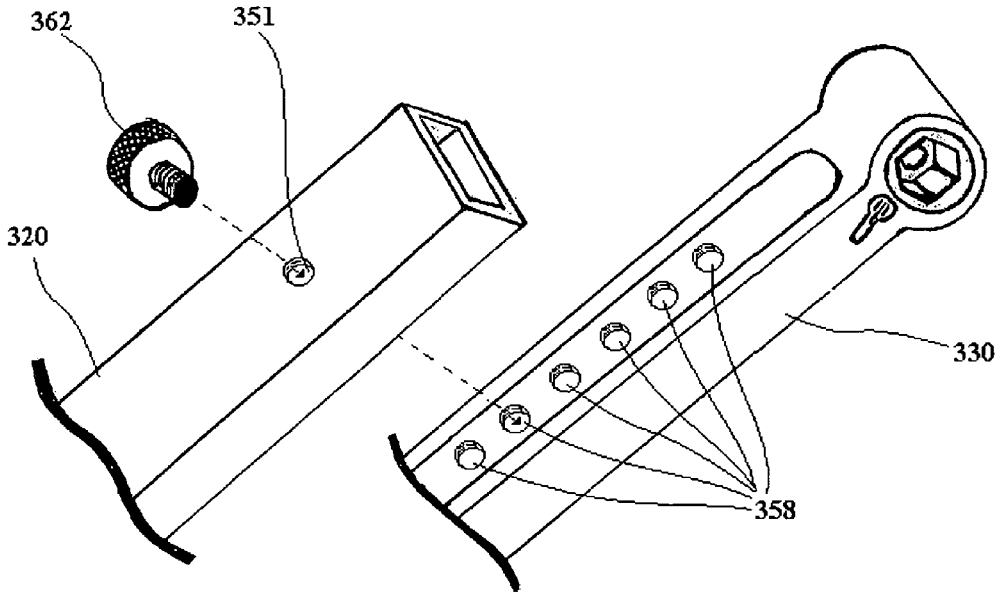
FIG. 4B is an exploded perspective view of the same embodiment of the jaw assembly and first arm securing mechanism shown in FIG. 4A.

In yet another alternative, the distal arm 330 of the first jaw portion 300 may have multiple threaded apertures 358, each threaded aperture 358 alignable with an aperture 351 in the proximate arm 320, with a threaded bolt 362 suitably adapted to be inserted into and through the aperture 351 of the proximate arm 320 and into one of the threaded apertures 358 of the distal arm 330. See FIGS. 4A and 4B. In such a configuration there is no need for a nut to secure the threaded bolt 362. Again, the second jaw portion 400 may have a similarly configured arm securing mechanism.

Figure 5A:
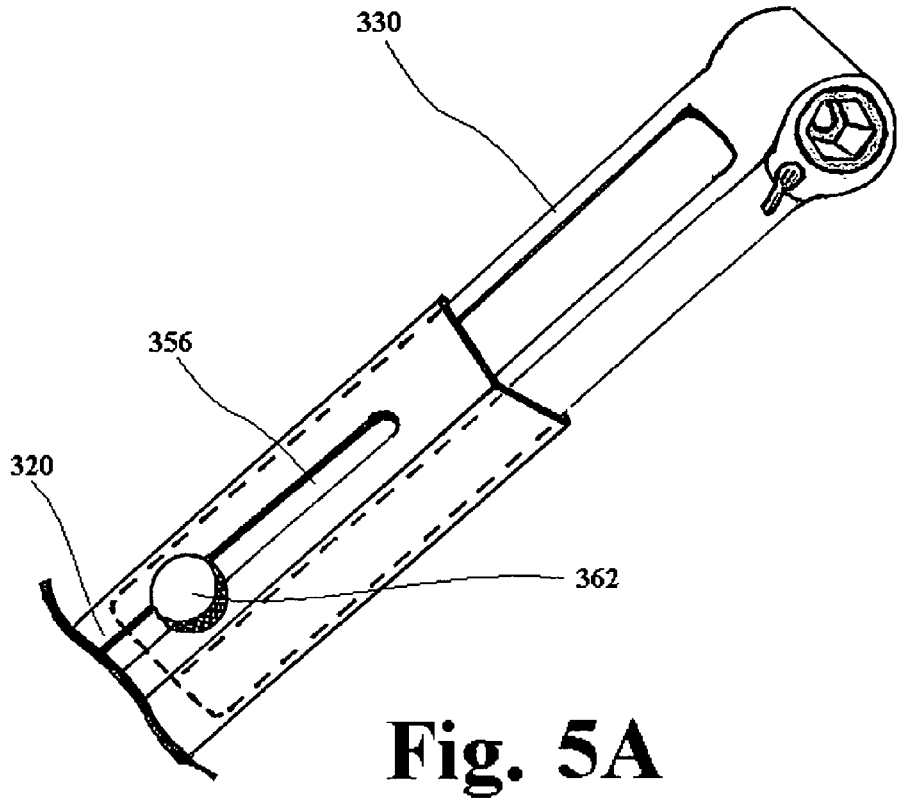
FIG. 5A is a plan view of the preferred embodiment of the jaw assembly and first arm securing mechanism, with ghost lines depicting obscured portion of distal arm of first jaw portion.
Figure 5B:
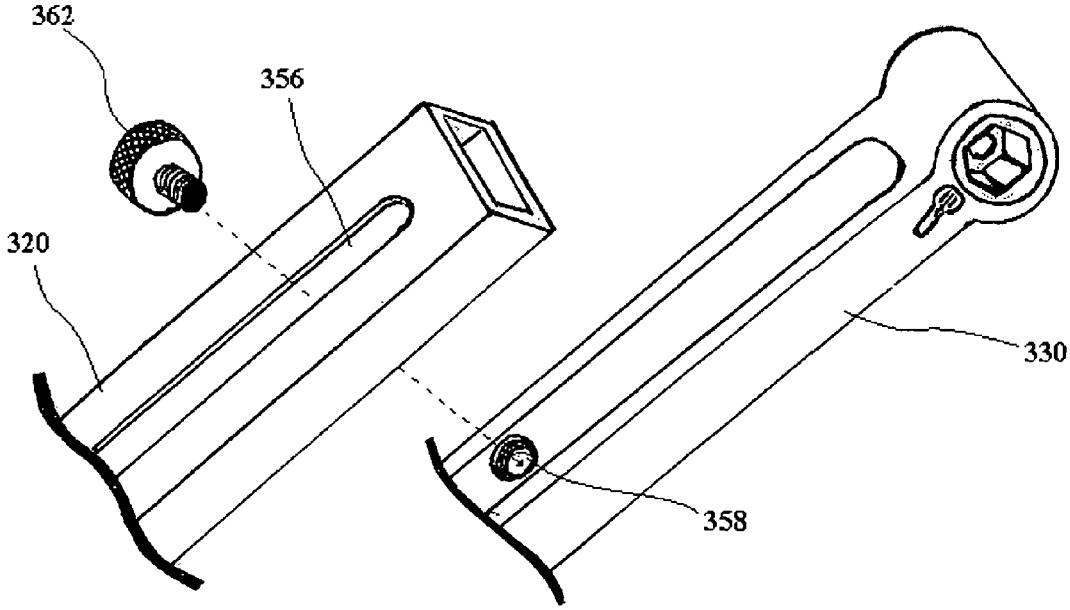
FIG. 5B is an exploded perspective view of the same embodiment of the jaw assembly and first arm securing mechanism shown in FIG. 5A.

In the preferred alternative, the proximate arm 320 of the first jaw portion 300 has an elongate aperture 356, the elongate aperture 356 passing completely through the proximate arm 320; the distal arm 330 has a threaded aperture 358 passing completely through the distal arm 330 and being alignable with the elongate aperture 356 of the proximate arm 320; and a threaded bolt 362 suitably adapted to be inserted into and through the elongate aperture 356 of the proximate arm 320 and into the threaded aperture 358 of the distal arm 330. See FIGS. 5A and 5B. In such a configuration there is no need for a nut to secure the threaded bolt 362. In a similar fashion the second jaw portion 400 may have a similarly configured arm securing mechanism.

Figure 6A:
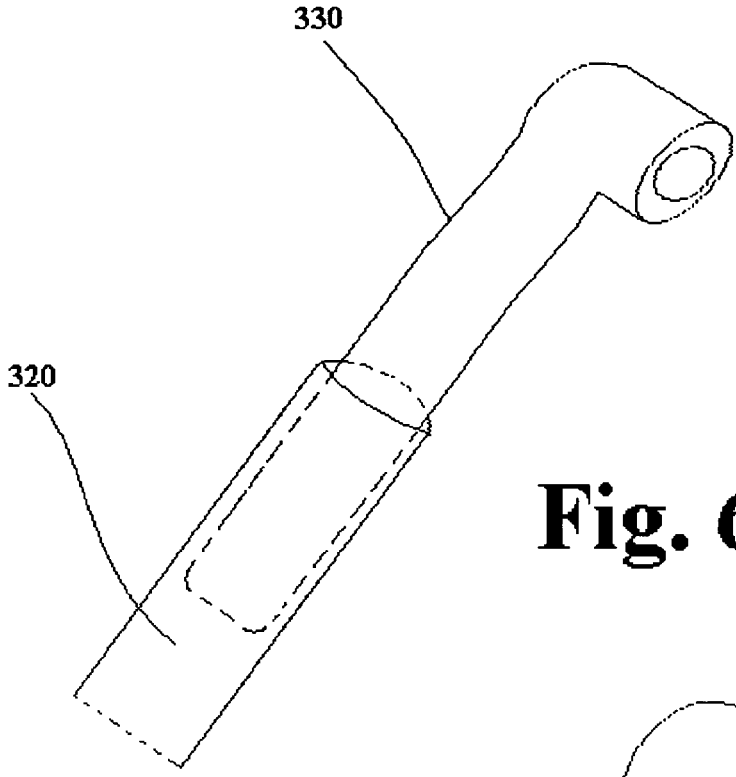
FIG. 6A is a plan view of one embodiment of the jaw assembly, with ghost lines depicting obscured portion of distal arm of first jaw portion.
Figure 6B:
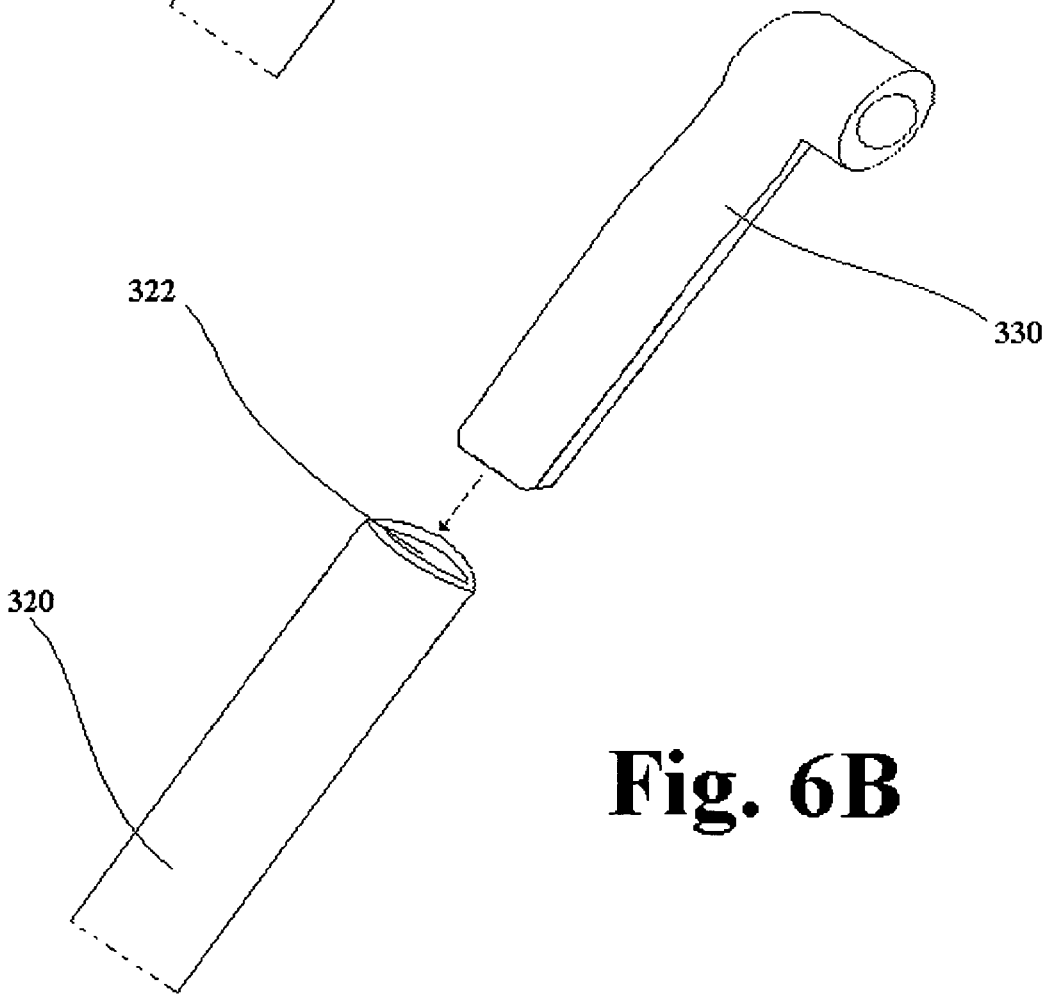
FIG. 6B is an exploded perspective view of the same embodiment of the jaw assembly shown in FIG. 6A.

In another embodiment of the clamping assembly 200 having two-part jaw portions 300,400, the proximate arm 320 of the first jaw portion 300 may be substantially hollow and have an aperture 322 at the end further from the handle assembly 100, with the distal arm 330 of the first jaw portion 300 fitting within this aperture 322 in a telescoping manner, such that the distal arm 330 is slidably positionable relative to the proximate arm 320. See FIGS. 6A and 6B. The distal arm 330 may be frictionally secured in a desired position relative to the proximate arm 320. Alternatively, the distal arm 330 may be mechanically secured in a desired position relative to the proximate arms 320 using an arm securing mechanism. If the distal 330 and proximate arms 320 are mechanically secured, one embodiment of the arm securing mechanism comprises a threaded aperture 354 in the surface of the proximate arm 320, the threaded aperture 354 passing completely through the surface of the proximate arm 320, together with a threaded bolt 362 suitably adapted to be inserted into the threaded aperture 354 and tightened and loosened by being rotated by a human hand, such that when tightened the threaded bolt 362 passes through the surface of the proximate arm 320 to securely engage the distal arm 330. This configuration is similar to that shown in FIGS. 3A and 3B. The proximate 420 and distal arms 430 of the second jaw portion 400 may be similarly configured to operate in a telescoping manner relative to each other.

In another embodiment of the present invention, the clamping assembly 200 comprises multi-part jaw portions 300,400. As before, the first jaw portion 300 comprises a proximate arm 320 and a distal arm 330, but in this configuration positioned between the proximate arm 320 and the distal arm 330 are one or more intermediate arms 340. The proximate arm 320, the distal arm 330, and the one or more intermediate arms 340 are suitably adapted to movably engage each other along their respective longitudinal axes, to permit the first jaw portion 300 to be lengthened or shortened depending on the positions of the proximate arm 320, the one or more intermediate arms 340, and the distal arm 330 in relation to each other. The proximate arm 320, the one or more intermediate arms 340, and the distal arm 330 may be held in fixed relation to each other by any of the arm securing mechanisms described above.

Figures 7A, 7B:
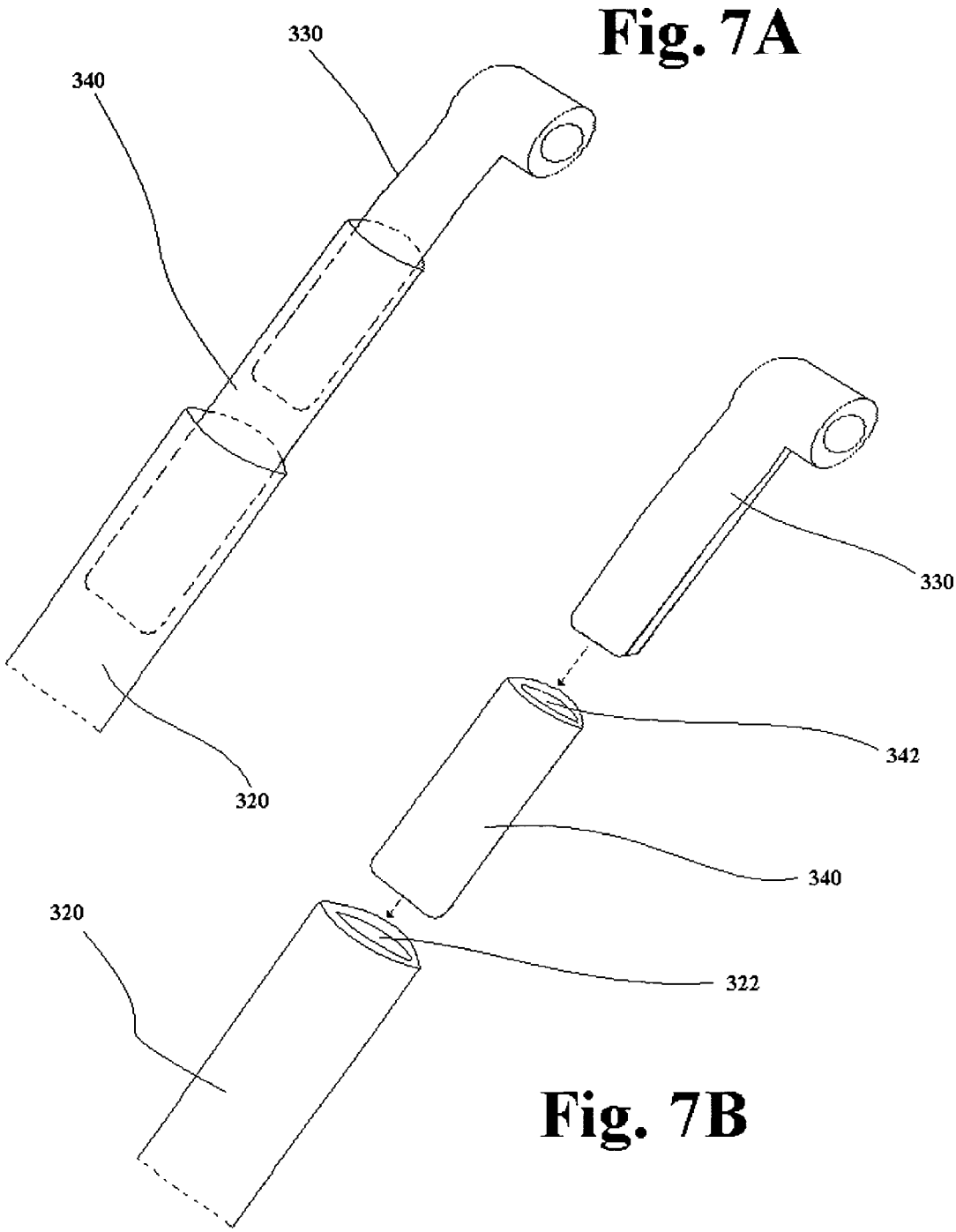
FIG. 7A is a plan view of one embodiment of the jaw assembly, with ghost lines depicting obscured portions of distal and intermediate arms of first jaw portion.
FIG. 7B is an exploded perspective view of the same embodiment of the jaw assembly shown in FIG. 7A.

In one embodiment of the multi-part jaw portion configuration the proximate arm 320 is substantially hollow and has an aperture 322 at the end further from the handle assembly 100. Each intermediate arm 340 is also substantially hollow and has an aperture 342 at the end further from the handle assembly 100. Each intermediate arm 340 and the distal arm 330 fit within the proximate arm 320 in a telescoping manner, with the distal arm 330 being the innermost of the arms, such that each of the intermediate arms 340 and the distal arm 330 are slidably positionable relative to each other and to the proximate arm 320. See FIGS. 7A and 7B. In this configuration the intermediate arm(s) 340 and the distal arm 330 may be frictionally secured in a desired position relative to each other and to the proximate arm 320. By using one or more intermediate arms 340 the first jaw portion 300 may be lengthened to a further degree than in the two-part jaw portion configuration. The second jaw portion 400 may be similarly configured with one or more intermediate arms operating in a telescoping manner together with the proximate 420 and distal arms 430.

Figure 8A:
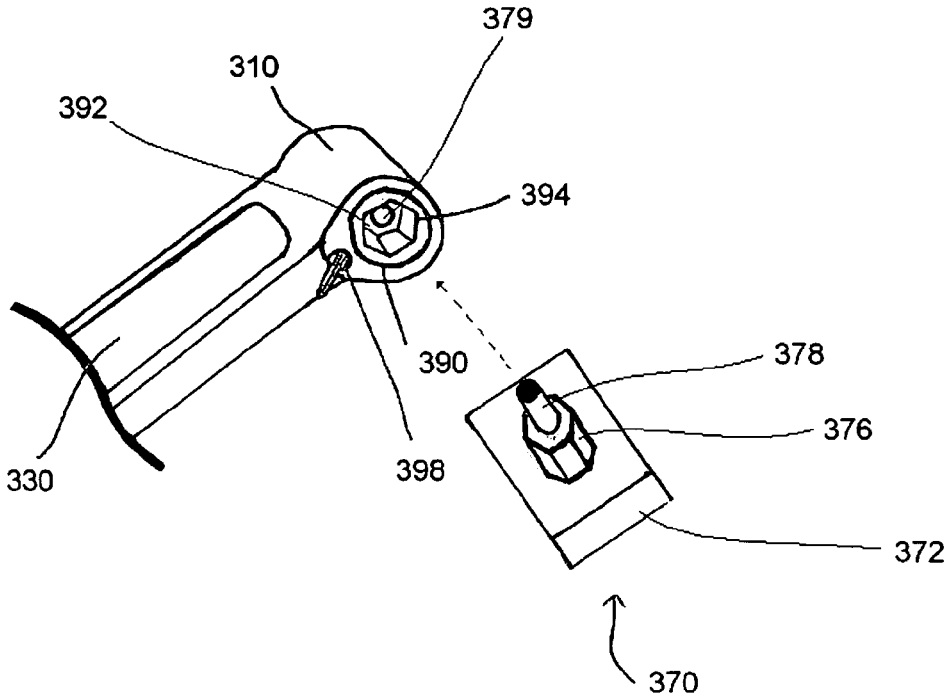
FIG. 8A is a perspective view of an embodiment of the first attachment component employing a ratchet mechanism.
Figure 11:
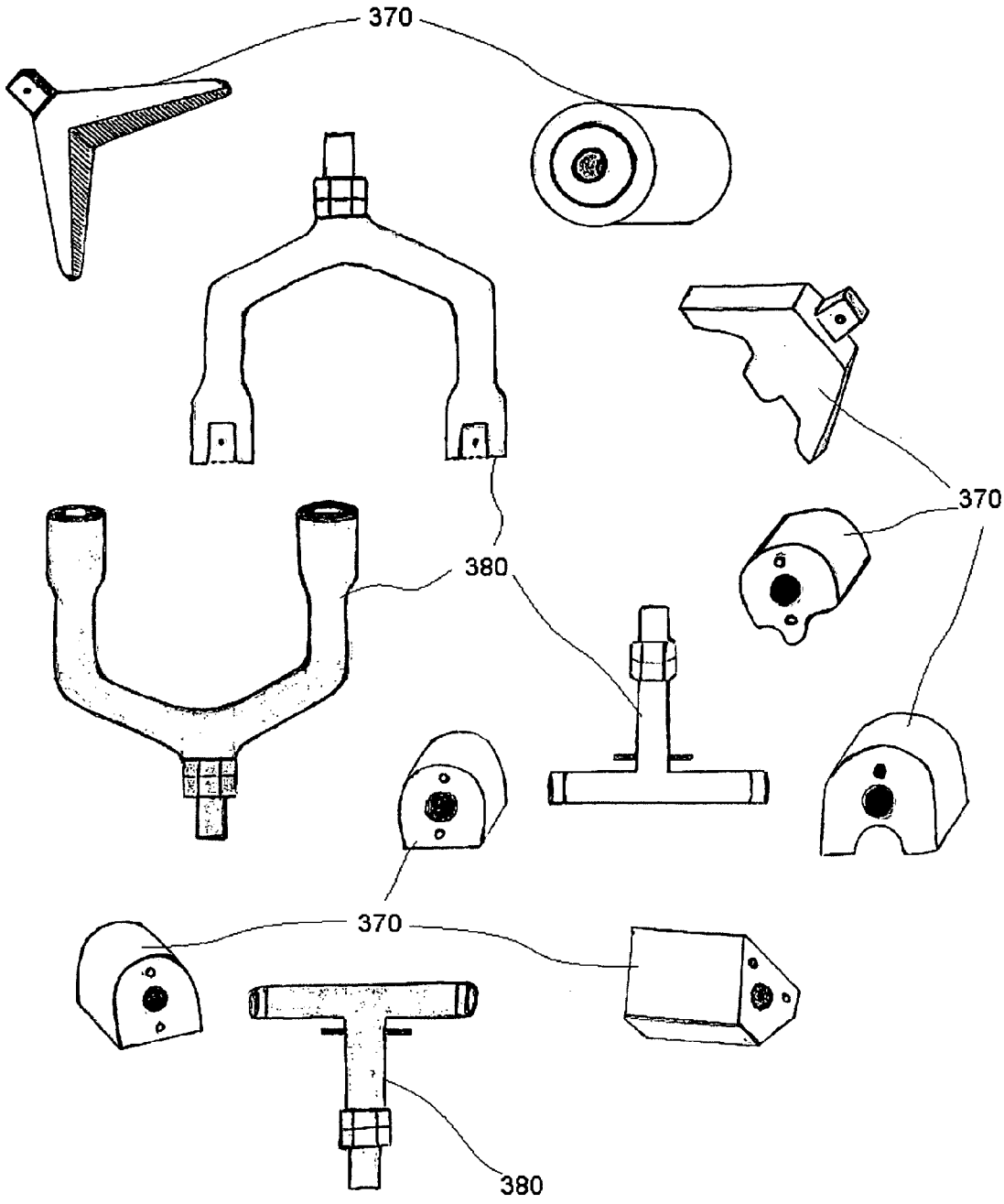
FIG. 11 shows various configurations of the clamping members, including clamping member extension adapters for use with multiple clamping members.

In yet another embodiment of the present invention, the clamping assembly 200 comprises a first clamping member 370 and a second clamping member 470, with each clamping member 370,470 suitably adapted to engage with a work piece. See FIG. 8A. The end of each jaw portion 300,400 of the clamping assembly 200 further from the handle assembly 100 is designated the clamping end 310,410, and each clamping member 370,470 is removably attached to the clamping end 310,410 of the respective jaw portion 300,400 by an attachment component. The ability to remove the clamping members 370,470 from the jaw portions 300,400 of the clamping assembly 200 allows for the interchangeability of clamping members 370,470 to suit different purposes. In the present invention the first attachment component 365 is suitably adapted to function as a "quick release" mechanism to allow for the removal and attachment of clamping members 370,470 quickly and easily without the need to use tools. One embodiment of the first attachment component 365 is an aperture formed into the clamping end 310 of the first jaw portion 300, said aperture suitably adapted to accommodate the attachment end 375 of the first clamping member 370, said attachment end 374 suitably adapted to be inserted into said aperture. In an alternative embodiment, multiple clamping members may be used with each jaw portion 300,400 by use of a clamping member extension adapter 380. See FIG. 11. The clamping member extension adapter 380 is interposed between the clamping end 310 of the jaw portion 300 and the clamping member 370, and has multiple attachment points to accommodate multiple clamping members 370.

In one variation of this embodiment of the present invention one or both of the clamping members 370,470 pivots relative to its respective clamping end 310,410 of the jaw portions 300,400 of the clamping assembly 200. The pivoting motion may be in one direction only, such as up and down or side to side, as may be achieved by use of an axle configuration, or the pivoting motion may be in multiple directions, such as may be achieved by a ball joint. The pivoting motion may also be achieved by any other suitable means known in the art.

In another variation of this embodiment of the present invention the first clamping member 370 rotates relative to the clamping end 310 of the first jaw portion 300 of the clamping assembly 200. Rotation is along an axis perpendicular to a longitudinal axis of the first jaw portion 300 of the clamping assembly 200. One embodiment of this variation has the attachment component comprising a ratchet mechanism 390 formed into the clamping end 310 of the first jaw portion 300 of the clamping assembly 200. See FIG. 8A. The ratchet mechanism 390 has an inner cavity 392 and a toothed ring 394, with the toothed ring 394 suitably adapted to rotate within the inner cavity 392 of the ratchet mechanism 390. In this embodiment the first clamping member 370 has a clamping surface 372 suitably adapted to engage with a work piece and an attachment end 374 opposite the clamping surface 372. The attachment end 374 of the first clamping member 370 is inserted into the inner cavity 392 of the corresponding ratchet mechanism 390, with the toothed ring 394 of the ratchet mechanism 390 securing the attachment end 374 of the first clamping member 370. Rotation of the toothed ring 394 within the ratchet mechanism 390 effects the relative rotation of the first clamping member 370. The attachment component of the second jaw portion 400 and the second clamping member 470 may likewise be similarly configured.

Figure 8B:
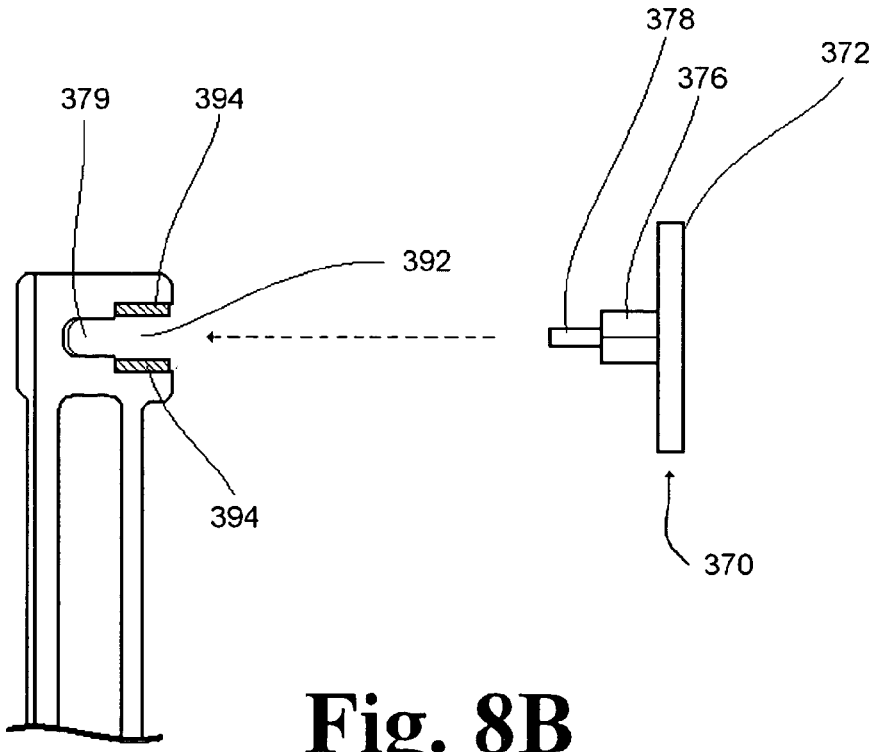
FIG. 8B is a plan view of the embodiment of the first attachment component together with a rear view of an embodiment of the first clamping member as shown in FIG. 8A.

In a further variation the attachment end 374 of the first clamping member 370 may have an inner shaft 376 and an outer shaft 378. The inner shaft 376 has substantially hexagonal sides and a greater diameter than the outer shaft 378, which is substantially cylindrical and centered on and coaxial with the inner shaft 376. Other appropriate shapes for the sides of the inner shaft 376 are also contemplated. Located behind the inner cavity 392 of the ratchet mechanism 390 is a cylindrical blind hole 379 formed into the clamping end 310 of the first jaw portion 300. The blind hole 379 has an inner diameter suitably dimensioned to snugly accommodate the diameter of the outer shaft 378 of the attachment end 374 of the first clamping member 370. The inner cavity 392 of the ratchet mechanism 390 is suitably dimensioned to accommodate the diameter of the inner shaft 376 of the attachment end 374 of the first clamping member 370. When the attachment end 374 of the first clamping member 370 is inserted into the ratchet mechanism 390, the outer shaft 378 of the attachment end 374 fits within and may rotate within the blind hole 379, and the inner shaft 376 of the attachment end 374 is maintained in a fixed position relative to the toothed ring 394 of the ratchet mechanism 390. See FIG. 8B. This configuration provides stability to and a more secure fit of the first clamping member 370 to the first jaw portion 300. Other elements known in the art, such as ball detents, o-rings, and the like, may be integrated into the attachment end 374 of the first clamping member 370 and/or the ratchet mechanism 390 to improve the security of the attachment while preserving the quick release functionality of the invention. The attachment component of the second jaw portion 400 and the second clamping member 470 may likewise be similarly configured.

In yet a further variation the ratchet mechanism 390 of the first attachment component 365 comprises a three-position switch 398, with the first position of the switch 398 permitting the ratchet mechanism 390 to rotate 360° in a first direction, the second position of the switch 398 permitting the ratchet mechanism 390 to rotate 360° in a second direction opposite the first direction, and the third position of the switch 398 locking the ratchet mechanism 390, preventing rotation. In yet a further variation the ratchet mechanism 390 comprises a two-position switch, with the two positions corresponding to the first two switch positions described above. The attachment component of the second jaw portion 400 may be similarly configured with either three-position or two-position switches in the ratchet mechanism. (If the two-position switch configuration is used, rotation of the clamping members 370,470 may be locked when the clamping assembly 200 is in the closed position if both the first and second attachment components have ratchet mechanisms and the ratchet mechanism switches of the two attachment components are set to rotate in opposite directions relative to each other.)

Figure 10:
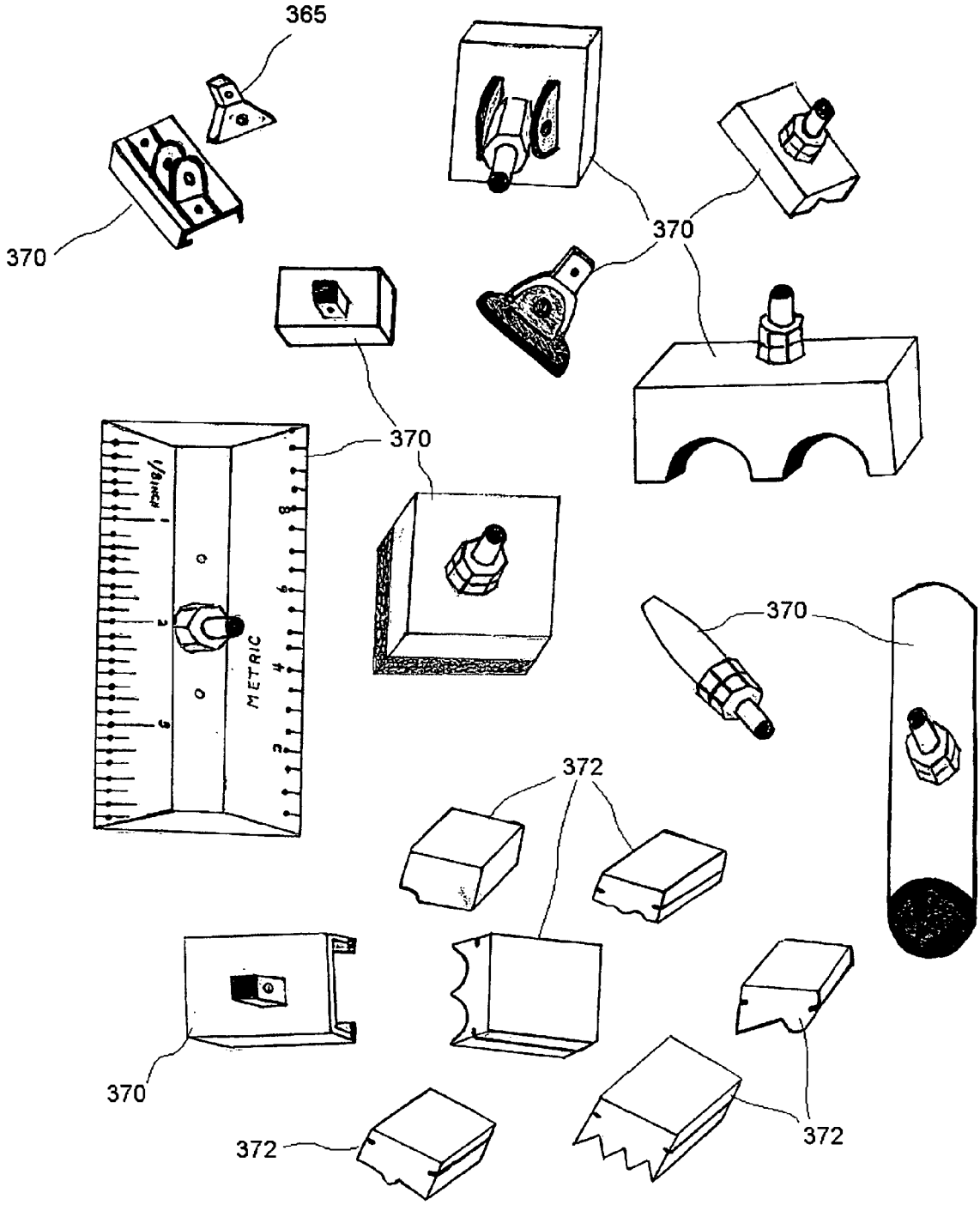
FIG. 10 shows various configurations of the clamping members, including clamping members with clip-on clamping surfaces.

The clamping members 370,470 in this embodiment may have clamping surfaces 372,472 of various hardnesses, textures, and shapes. The clamping surfaces 372,472 may be made of a hard, inflexible material, such as tempered steel, or a soft, flexible material, such as a polymer plastic. The clamping surfaces 372,472 may be substantially planar. The clamping surfaces 372,472 may be substantially concave. The clamping surfaces 372,472 may be substantially convex. The clamping surfaces 372,472 may be irregularly shaped. See FIGS. 10 and 11. The clamping surfaces 372,472 may be constructed of a non-stick compound to better enable the device 1 to be used with adhesives. The two clamping members 370,470 need not have clamping surfaces 372,472 with the same hardness, texture, or shape. The clamping members 372,472 may further comprise removable clamping surfaces 372,472, whereby the clamping surfaces 372,472 may be clipped on and off the clamping members 370,470. See FIG. 10. This embodiments permits reusable clamping surfaces 372,472 for applications where they are prone to damage or wear. The ability to interchange clamping members 370,470 having various hardnesses, textures, and shapes allows the locking clamp device 1 to be used in a wide range of applications. One such application is for automobile body work, where the various body panels of the automobile have different shapes. Clamping members 370,470 may be designed to fit specific body panels from various automobile manufacturers so that the panels may be held securely and without damage.

Figure 9:
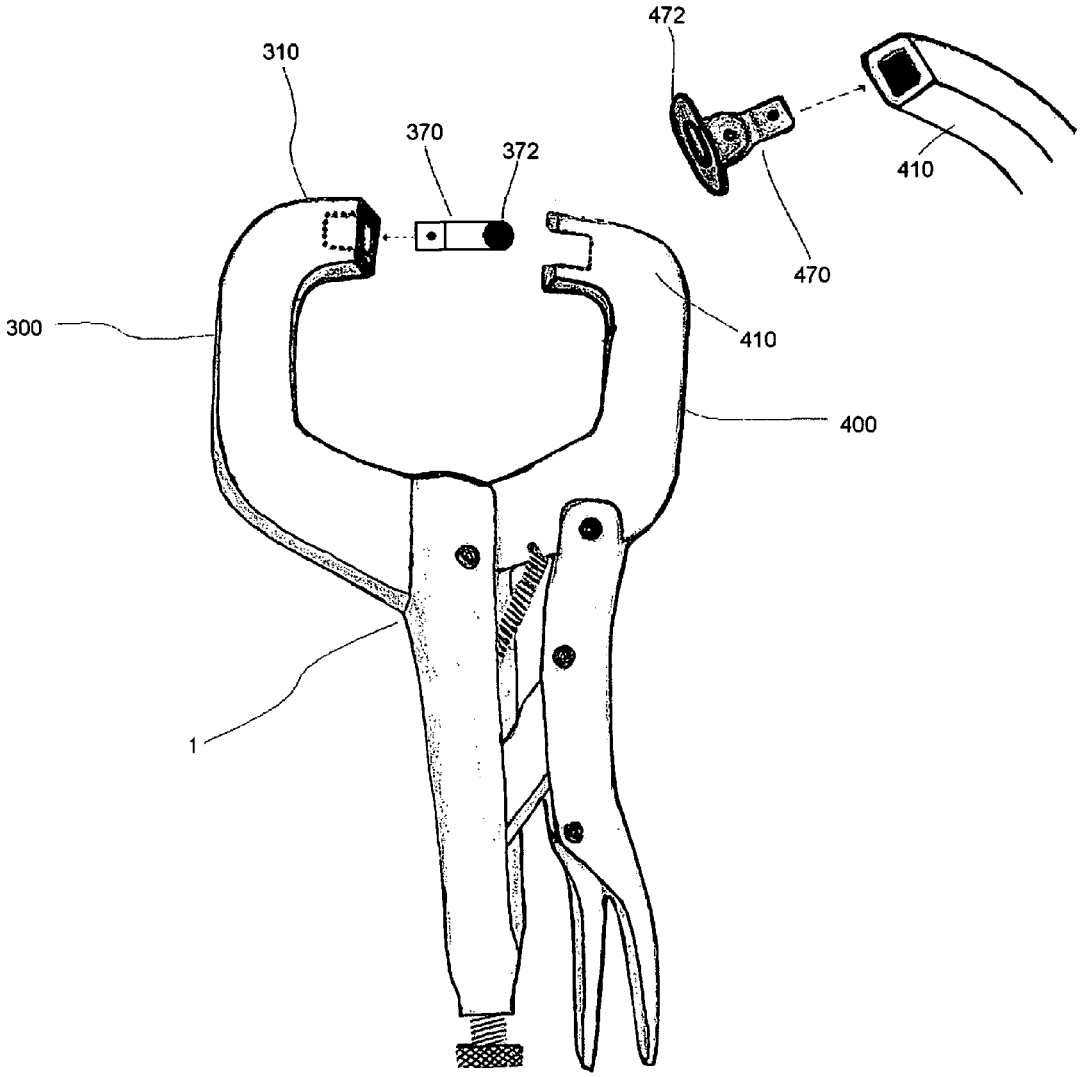
FIG. 9 is a plan view of one embodiment of the clamping members adapted to replicate the appearance of a spot weld.

In one embodiment the clamping members 370,470 are a matched pair, with the first clamping member 370 having a substantially convex clamping surface 372, being substantially circular, and the second clamping member 470 having a substantially concave clamping surface 472, also substantially circular. The concavity of the clamping surface 472 of the second clamping member 470 has a diameter just slightly greater than a diameter of the convexity of the clamping surface 372 of the first clamping member 370, such that the concavity of the clamping surface 472 of the second clamping member 470 accommodates the convexity of the clamping surface 372 of the first clamping member 370. See FIG. 9. When the locking clamp device 1 is placed onto a body panel and the clamping assembly 200 is placed in the closed position, the force of the clamping surfaces 372,472 of the first and second clamping members 370,470 on the panel replicates the appearance of a spot weld. Body panels may then be bonded together with adhesives rather than welding and held together with the locking clamp device 1, providing a simple, improved, and cost-efficient alternative to welding while retaining the traditional appearance of welding, which is much desired in the field of automobile restoration.

The potentially unlimited range of shapes, textures, and hardnesses of the clamping surfaces 372,472 of the clamping members 370,470 provides virtually unlimited uses for the present invention.

In the preferred embodiment of the present invention, the locking clamp device 1 comprises the clamping assembly 200 with both the extendable jaw portions 300,400 and the quick release, interchangeable clamping members 370,470. This combination gives the present invention a flexibility and usefulness not found in any comparable tool.

In an alternative embodiment of the present invention, the user may be assisted in manipulating the handle assembly 100 by the inclusion of an electro-mechanical or pneumatic device integrated with the handle assembly 100. Such devices are well-known in the art and are frequently integrated with hand tools used in the automobile repair industry.

Figure 12:
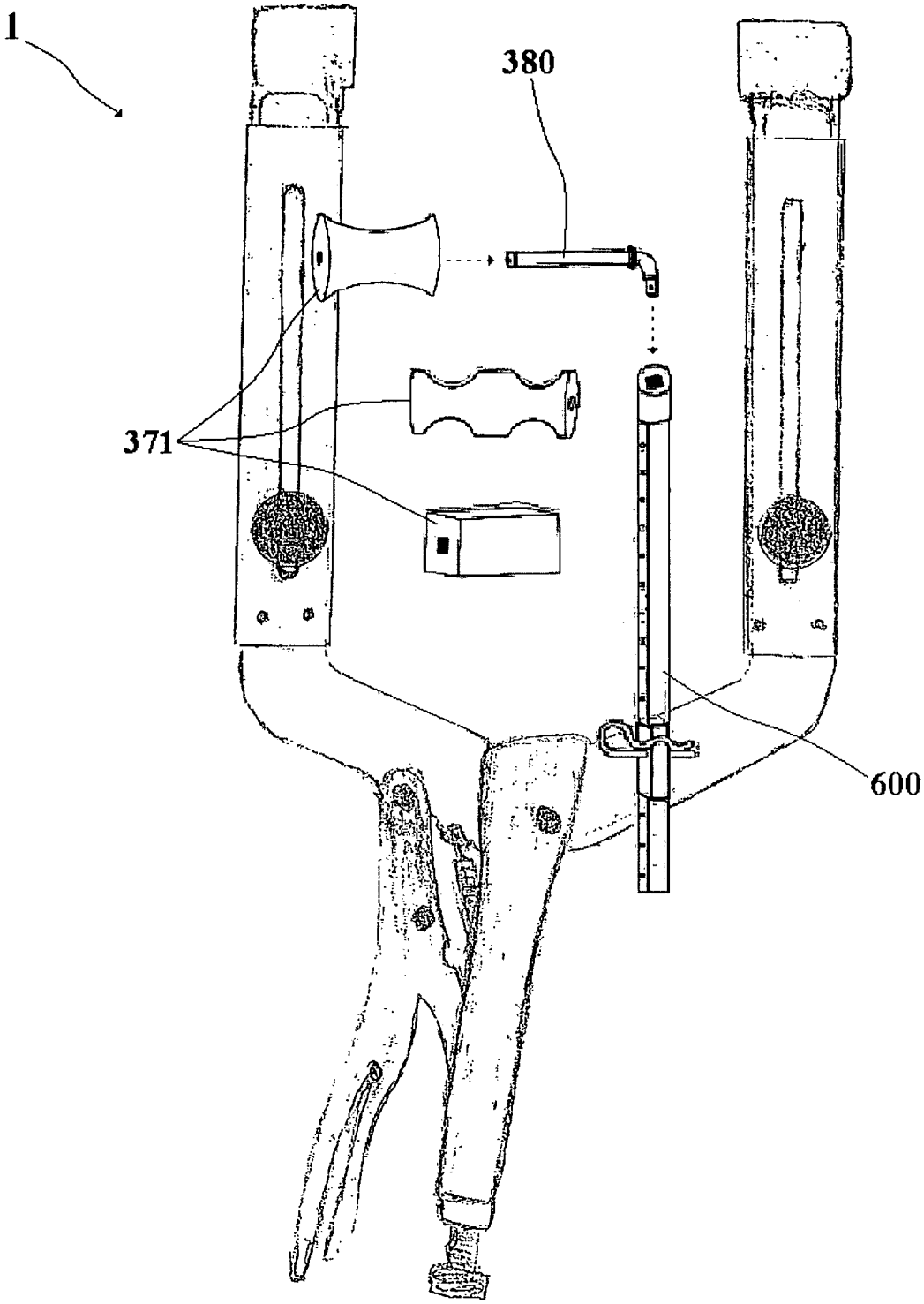
FIG. 12 shows an alternative embodiment of the locking clamp device comprising a third holding arm.

In yet another embodiment of the present invention a third holding arm 600 is attached to the clamping assembly 200. See FIG. 12. The third holding arm 600 is suitably adapted to work in conjunction with the jaw portions 300,400 to hold a work piece or to attach the device 1 to a structure in order to better accommodate a work piece. Clamping members 371 may be used with the third holding arm 600, as clamping member extension adapters 380. The third holding arm 600 may be adjustable.

Modifications and variations can be made to the disclosed embodiments of the invention without departing from the subject or spirit of the invention.

I claim:

1. A locking clamp device, comprising a handle assembly, having a first handle portion and a second handle portion, said handle portions suitably adapted to be held and manipulated by a human hand;

a clamping assembly attached to and actuated by the handle assembly to an opened position or a closed position, said clamping assembly having a first jaw portion having a clamping end distal to the handle assembly, said first jaw portion comprised of a proximate arm and a distal arm, said proximate arm located proximate to the handle assembly and said distal arm located proximate to said clamping end of the first jaw portion, with said proximate arm and said distal arm suitably adapted to movably engage each other along their respective longitudinal axes such that said first jaw portion may be lengthened or shortened depending on the positions of said proximate arm and said distal arm in relation to each other, wherein the proximate arm of the first jaw portion is substantially hollow and has an aperture at an end distal from the handle assembly and the distal arm of the first jaw portion is suitably adapted to fit within the aperture of proximate arm of the first jaw portion in a telescoping manner, such that the distal arm of the first jaw portion is slidably positionable relative to the proximate arm of the first jaw portion, and the distal arm of the first jaw portion is frictionally secured in a desired position relative to the proximate arm of the first jaw portion; and a second jaw portion having a clamping end distal to the handle assembly, and a locking means integrated with the handle assembly and the clamping assembly, said locking means suitably adapted to hold the clamping ends of the respective jaw portions in the closed position;

whereby the closed position of the clamping assembly comprises a relative orientation of the clamping end of the first jaw portion with the clamping end of the second jaw portion in which said clamping ends are sufficiently engaged with a work piece to hold the work piece securely within the locking clamp device or to hold the locking clamp device securely to the work piece, and the opened position of the clamping assembly comprises a relative orientation of the clamping end of the first jaw portion with the clamping end of the second jaw portion in which said clamping ends are sufficiently disengaged from a work piece to permit removal of the work piece from the locking clamp device or to permit removal of the locking clamp device from the work piece.

2. The locking clamp device of claim 1 wherein the distal arm of the first jaw portion is frictionally secured in a desired position relative to the proximate arm of the first jaw portion.

3. The locking clamp device of claim 1 wherein the distal arm of the first jaw portion is mechanically secured in a desired position relative to the proximate arm of the first jaw portion by a first arm securing mechanism.

4. The locking clamp device of claim 3 wherein the first arm securing mechanism comprises an elongate aperture in the proximate arm of the first jaw portion, said elongate aperture passing completely through said proximate arm and oriented substantially along a longitudinal axis of said proximate arm, an elongate aperture in the distal arm of the first jaw portion, said elongate aperture passing completely through said distal arm and aligned at least partially with the elongate aperture of the proximate arm of the first jaw portion, a first threaded bolt suitably adapted to be inserted into and through said elongate aperture of the proximate arm of the first jaw portion and into and through said elongate aperture of the distal arm of the first jaw portion, and a first nut suitably adapted to receive said first threaded bolt such that said first threaded bolt may be tightened and loosened relative to the first nut by being rotated by a human hand, such that said first threaded bolt may securely engage the proximate arm of the first jaw portion to the distal arm of the first jaw portion.

5. The locking clamp device of claim 1, wherein the clamping assembly further comprises a first clamping member, said first clamping member removably attached to the clamping end of the first jaw portion by a first attachment component, with said first clamping member suitably adapted to engage with a work piece, and a second clamping member, said second clamping member removably attached to the clamping end of the second jaw portion by a second attachment component, with said second clamping member suitably adapted to engage with a work piece; whereby the closed position of the clamping assembly comprises a relative orientation of the first clamping member with the second clamping member in which said clamping members are sufficiently engaged with a work piece to hold the work piece securely within the locking clamp device or to hold the locking clamp device securely to the work piece, and the opened position of the clamping assembly comprises a relative orientation of the first clamping member with the second clamping member in which said clamping members are sufficiently disengaged from a work piece to permit removal of the work piece from the locking clamp device or to permit removal of the locking clamp device from the work piece.

6. The locking clamp device of claim 5, wherein the first clamping member has a substantially convex clamping surface suitably adapted to engage with a work piece, said convexity being substantially circular; and the second clamping member has a substantially concave clamping surface suitably adapted to engage with a work piece, said concavity being substantially circular;

with the concavity of the clamping surface of the second clamping member having a diameter just slightly greater than a diameter of the convexity of the clamping surface of the first clamping member, such that the concavity of the clamping surface of the second clamping member is suitably adapted to accommodate the convexity of the clamping surface of the first clamping member.

7. The locking clamp device of claim 1, wherein the handle assembly further comprises a powered assist device, said powered assist device being integrated with the handle assembly and being suitably adapted to assist a user with the manipulation of the first and second handle portions by the human hand in order to actuate the clamping assembly between the opened or the closed position.

8. A locking clamp device, comprising a handle assembly, having a first handle portion and a second handle portion, said handle portions suitably adapted to be held and manipulated by a human hand;

a clamping assembly attached to and actuated by the handle assembly to an opened position or a closed position, said clamping assembly having a first jaw portion having a clamping end distal to the handle assembly, said first jaw portion comprised of a proximate arm and a distal arm, said proximate arm located proximate to the handle assembly and said distal arm located proximate to said clamping end of the first jaw portion, with said proximate arm and said distal arm suitably adapted to movably engage each other along their respective longitudinal axes such that said first jaw portion may be lengthened or shortened depending on the positions of said proximate arm and said distal arm in relation to each other; and a second jaw portion having a clamping end distal to the handle assembly, and a locking means integrated with the handle assembly and the clamping assembly, said locking means suitably adapted to hold the clamping ends of the respective jaw portions in the closed position;

wherein the clamping assembly further comprises a first clamping member, said first clamping member removably attached to the clamping end of the first jaw portion by a first attachment component, with said first clamping member suitably adapted to engage with a work piece;

whereby the closed position of the clamping assembly comprises a relative orientation of the first clamping member with the clamping end of the second jaw portion in which said clamping member and clamping end of the second jaw portion are sufficiently engaged with a work piece to hold the work piece securely within the locking clamp device or to hold the locking clamp device securely to the work piece, and the opened position of the clamping assembly comprises a relative orientation of the first clamping member with the clamping end of the second jaw portion in which said clamping member and clamping end of the second jaw portion are sufficiently disengaged from a work piece to permit removal of the work piece from the locking clamp device or to permit removal of the locking clamp device from the work piece.

9. The locking clamp device of claim 8, wherein the first clamping member pivots relative to the clamping end of the first jaw portion of the clamping assembly.

10. The locking clamp device of claim 8, wherein the first clamping member rotates relative to the clamping end of the first jaw portion of the clamping assembly along an axis perpendicular to a longitudinal axis of the first jaw portion of the clamping assembly.

11. The locking clamp device of claim 8, wherein the first clamping member has a clamping surface suitably adapted to engage with a work piece, said clamping surface being made of either a hard, inflexible material or a soft, flexible material.

12. The locking clamp device of claim 8, wherein the first clamping member has a substantially planar clamping surface suitably adapted to engage with a work piece or a substantially concave clamping surface suitably adapted to engage with a work piece or a substantially convex clamping surface suitably adapted to engage with a work piece or an irregularly shaped clamping surface suitably adapted to engage with a work piece.

13. The locking clamp device of claim 8, wherein the first clamping member comprises a clamping surface suitably adapted to engage with a work piece, said clamping surface suitably adapted to be removably attached to the first clamping member.

14. The locking clamp device of claim 8 further comprising a clamping member extension adapter, said clamping member extension adapter suitably adapted to be removably attached to the clamping end of the first jaw portion by an adapter attachment component and suitably adapted to accommodate the first attachment component of the first clamping member such that the first clamping member is removably attached to the clamping member extension adapter.

15. The locking clamp device of claim 14 further comprising a second clamping member, said second clamping member having a second attachment component;

wherein the clamping member extension adapter is suitably adapted to accommodate the second attachment component of the second clamping member such that the second clamping member is removably attached to the clamping member extension adapter.

16. A locking clamp device comprising a handle assembly, having a first handle portion and a second handle portion, said handle portions suitably adapted to be held and manipulated by a human hand;

a clamping assembly attached to and actuated by the handle assembly to an opened position or a closed position, said clamping assembly having a first jaw portion having a clamping end distal to the handle assembly, said first jaw portion comprised of a proximate arm and a distal arm, said proximate arm located proximate to the handle assembly and said distal arm located proximate to said clamping end of the first jaw portion, with said proximate arm and said distal arm suitably adapted to movably engage each other along their respective longitudinal axes such that said first jaw portion may be lengthened or shortened depending on the positions of said proximate arm and said distal arm in relation to each other, and a first clamping member, said first clamping member removably attached to the clamping end of the first jaw portion by a first attachment component, with said first clamping member suitably adapted to engage with a work piece; and a second jaw portion having a clamping end distal to the handle assembly; and a locking means integrated with the handle assembly and the clamping assembly, said locking means suitably adapted to hold the clamping ends of the respective jaw portions in the closed position;

whereby the closed position of the clamping assembly comprises a relative orientation of the first clamping member of the first jaw portion with the clamping end of the second jaw portion in which said clamping member and clamping end of the second jaw portion are sufficiently engaged with a work piece to hold the work piece securely within the locking clamp device or to hold the locking clamp device securely to the work piece, and the opened position of the clamping assembly comprises a relative orientation of the first clamping member of the first jaw portion with the clamping end of the second jaw portion in which said clamping member and clamping end of the second jaw portion are sufficiently disengaged from a work piece to permit removal of the work piece from the locking clamp device or to permit removal of the locking clamp device from the work piece;

wherein the first clamping member rotates relative to the clamping end of the first jaw portion of the clamping assembly along an axis perpendicular to a longitudinal axis of the first jaw portion of the clamping assembly, and the first clamping member has a clamping surface suitably adapted to engage with a work piece and an attachment end opposite the clamping surface of the first clamping member; and the first attachment component comprises a first ratchet mechanism formed into the clamping end of the first jaw portion of the clamping assembly, said first ratchet mechanism having an inner cavity and a toothed ring, said toothed ring suitably adapted to rotate within said inner cavity;

whereby the attachment end of the first clamping member is suitably adapted to be inserted into the first ratchet mechanism and said first ratchet mechanism is suitably adapted to removably secure the attachment end of the first clamping member to the clamping end of the first jaw portion, with the first clamping member rotatable within the first attachment component by operation of the first ratchet mechanism.

17. The locking clamp device of claim 16, wherein the attachment end of the first clamping member has an inner shaft and an outer shaft, with said inner shaft having substantially hexagonal sides and a greater diameter than said outer shaft, with said outer shaft being substantially cylindrical and centered on and coaxial with said inner shaft;

the inner cavity of the first ratchet mechanism having a suitable dimension to accommodate the diameter of the inner shaft of the attachment end of the first clamping member;

the first attachment component further comprising a cylindrical first blind hole formed into the clamping end of the first jaw portion of the clamping assembly and having an inner diameter of a suitable dimension to accommodate the diameter of the outer shaft of the attachment end of the first clamping member, said first blind hole located behind the first ratchet mechanism;

whereby the toothed ring of the first ratchet mechanism is suitably adapted to grip the hexagonal sides of the inner shaft of the attachment end of the first clamping member such that when the attachment end of the first clamping member is inserted into the first ratchet mechanism the inner shaft of the attachment end of the first clamping member is maintained in a fixed position relative to the toothed ring of the first ratchet mechanism, and the outer shaft of the attachment end of the first clamping member may rotate within the first blind hole.

18. The locking clamp device of claim 16, wherein the first ratchet mechanism comprises a two-position switch, with the first position of said switch permitting the first ratchet mechanism to rotate 360° in a first direction, and the second position of said switch permitting the first ratchet mechanism to rotate 360° in a second direction opposite said first direction.

19. The locking clamp device of claim 16, wherein the first ratchet mechanism comprises a three-position switch, with the first position of said switch permitting the first ratchet mechanism to rotate 360° in a first direction, the second position of said switch permitting the first ratchet mechanism to rotate 360° in a second direction opposite said first direction, and the third position of said switch locking the first ratchet mechanism, preventing rotation.

20. A locking clamp device, comprising a handle assembly, having a first handle portion and a second handle portion, said handle portions suitably adapted to be held and manipulated by a human hand;

a clamping assembly attached to and actuated by the handle assembly to an opened position or a closed position, said clamping assembly having a first jaw portion having a clamping end distal to the handle assembly, a second jaw portion having a clamping end distal to the handle assembly, and a first clamping member, said first clamping member removably attached to the clamping end of the first jaw portion by a first attachment component, with said first clamping member suitably adapted to engage with a work piece; and a locking means integrated with the handle assembly, said locking means suitably adapted to hold the clamping assembly in the closed position;

whereby the closed position of the clamping assembly comprises a relative orientation of the first clamping member with the clamping end of the second jaw portion in which said clamping member and clamping end of the second jaw portion are sufficiently engaged with a work piece to hold the work piece securely within the locking clamp device or to hold the locking clamp device securely to the work piece, and the opened position of the clamping assembly comprises a relative orientation of the first clamping member with the clamping end of the second jaw portion in which said clamping member and clamping end of the second jaw portion are sufficiently disengaged from a work piece to permit removal of the work piece from the locking clamp device or to permit removal of the locking clamp device from the work piece.

21. The locking clamp device of claim 20, wherein the first clamping member pivots relative to the clamping end of the first jaw portion of the clamping assembly.

22. The locking clamp device of claim 20, wherein the first clamping member rotates relative to the clamping end of the first jaw portion of the clamping assembly along an axis perpendicular to a longitudinal axis of the first jaw portion of the clamping assembly.

23. The locking clamp device of claim 20, wherein the first clamping member has a clamping surface suitably adapted to engage with a work piece, said clamping surface being made of either a hard, inflexible material or a soft, flexible material.

24. The locking clamp device of claim 20, wherein the first clamping member has a substantially planar clamping surface suitably adapted to engage with a work piece or a substantially concave clamping surface suitably adapted to engage with a work piece or a substantially convex clamping surface suitably adapted to engage with a work piece or an irregularly shaped clamping surface suitably adapted to engage with a work piece.

25. The locking clamp device of claim 20, wherein the first clamping member comprises a clamping surface suitably adapted to engage with a work piece, said clamping surface suitably adapted to be removably attached to the first clamping member.

26. The locking clamp device of claim 20 further comprising a clamping member extension adapter, said clamping member extension adapter suitably adapted to be removably attached to the clamping end of the first jaw portion by an adapter attachment component and suitably adapted to accommodate the first attachment component of the first clamping member such that the first clamping member is removably attached to the clamping member extension adapter.

27. The locking clamp device of claim 26 further comprising a second clamping member, said second clamping member having a second attachment component;

wherein the clamping member extension adapter is suitably adapted to accommodate the second attachment component of the second clamping member such that the second clamping member is removably attached to the clamping member extension adapter.

28. The locking clamp device of claim 20, wherein the clamping assembly further comprises a second clamping member, said second clamping member removably attached to the clamping end of the second jaw portion by a second attachment component, with said second clamping member suitably adapted to engage with a work piece;

whereby the closed position of the clamping assembly comprises a relative orientation of the first clamping member with the second clamping member in which said clamping members are sufficiently engaged with a work piece to hold the work piece securely within the locking clamp device or to hold the locking clamp device securely to the work piece, and the opened position of the clamping assembly comprises a relative orientation of the first clamping member with the second clamping member in which said clamping members are sufficiently disengaged from a work piece to permit removal of the work piece from the locking clamp device or to permit removal of the locking clamp device from the work piece.

29. The locking clamp device of claim 28, wherein the first clamping member has a substantially convex clamping surface suitably adapted to engage with a work piece, said convexity being substantially circular; and the second clamping member has a substantially concave clamping surface suitably adapted to engage with a work piece, said concavity being substantially circular;

with the concavity of the clamping surface of the second clamping member having a diameter just slightly greater than a diameter of the convexity of the clamping surface of the first clamping member, such that the concavity of the clamping surface of the second clamping member is suitably adapted to accommodate the convexity of the clamping surface of the first clamping member.

30. The locking clamp device of claim 20, wherein the handle assembly further comprises a powered assist device, said powered assist device being integrated with the handle assembly and being suitably adapted to assist a user with the manipulation of the first and second handle portions by the human hand in order to actuate the clamping assembly between the opened or the closed position.

31. A locking clamp device comprising a handle assembly, having a first handle portion and a second handle portion, said handle portions suitably adapted to be held and manipulated by a human hand;

a clamping assembly attached to and actuated by the handle assembly to an opened position or a closed position, said clamping assembly having a first jaw portion having a clamping end distal to the handle assembly, a second jaw portion having a clamping end distal to the handle assembly, and a first clamping member, said first clamping member removably attached to the clamping end of the first jaw portion by a first attachment component, with said first clamping member suitably adapted to engage with a work piece; and a locking means integrated with the handle assembly, said locking means suitably adapted to hold the clamping assembly in the closed position;

whereby the closed position of the clamping assembly comprises a relative orientation of the first clamping member with the clamping end of the second jaw portion in which said clamping member and clamping end of the second jaw portion are sufficiently engaged with a work piece to hold the work piece securely within the locking clamp device or to hold the locking clamp device securely to the work piece, and the opened position of the clamping assembly comprises a relative orientation of the first clamping member with the clamping end of the second jaw portion in which said clamping member and clamping end of the second jaw portion are sufficiently disengaged from a work piece to permit removal of the work piece from the locking clamp device or to permit removal of the locking clamp device from the work piece;

wherein the first clamping member rotates relative to the clamping end of the first jaw portion of the clamping assembly along an axis perpendicular to a longitudinal axis of the first jaw portion of the clamping assembly, and the first clamping member has a clamping surface suitably adapted to engage with a work piece and an attachment end opposite the clamping surface of the first clamping member; and the first attachment component comprises a first ratchet mechanism formed into the clamping end of the first jaw portion of the clamping assembly, said first ratchet mechanism having an inner cavity and a toothed ring, said toothed ring suitably adapted to rotate within said inner cavity, and the attachment end of the first clamping member;

whereby the attachment end of the first clamping member is suitably adapted to be inserted into the first ratchet mechanism and said first ratchet mechanism is suitably adapted to removably secure the attachment end of the first clamping member to the clamping end of the first jaw portion, with the first clamping member rotatable within the first attachment component by operation of the first ratchet mechanism.

32. The locking clamp device of claim 31, wherein the attachment end of the first clamping member has an inner shaft and an outer shaft, with said inner shaft having substantially hexagonal sides and a greater diameter than said outer shaft, with said outer shaft being substantially cylindrical and centered on and coaxial with said inner shaft;

the inner cavity of the first ratchet mechanism having a suitable dimension to accommodate the diameter of the inner shaft of the attachment end of the first clamping member;

the first attachment component further comprising a cylindrical first blind hole formed into the clamping end of the first jaw portion of the clamping assembly and having an inner diameter of a suitable dimension to accommodate the diameter of the outer shaft of the attachment end of the first clamping member, said first blind hole located behind the first ratchet mechanism;

whereby the toothed ring of the first ratchet mechanism is suitably adapted to grip the hexagonal sides of the inner shaft of the attachment end of the first clamping member such that when the attachment end of the first clamping member is inserted into the first ratchet mechanism the inner shaft of the attachment end of the first clamping member is maintained in a fixed position relative to the toothed ring of the first ratchet mechanism, and the outer shaft of the attachment end of the first clamping member may rotate within the first blind hole.

33. The locking clamp device of claim 31, wherein the first ratchet mechanism comprises a two-position switch, with the first position of said switch permitting the first ratchet mechanism to rotate 360° in a first direction, and the second position of said switch permitting the first ratchet mechanism to rotate 360° in a second direction opposite said first direction.

34. The locking clamp device of claim 31, wherein the first ratchet mechanism comprises a three-position switch, with the first position of said switch permitting the first ratchet mechanism to rotate 360° in a first direction, the second position of said switch permitting the first ratchet mechanism to rotate 360° in a second direction opposite said first direction, and the third position of said switch locking the first ratchet mechanism, preventing rotation.

* * * * *